US008214961B2

(12) United States Patent
Vinci et al.

(10) Patent No.: US 8,214,961 B2
(45) Date of Patent: Jul. 10, 2012

(54) APPARATUS FOR CLEANING MALE ELECTRICAL PINS

(75) Inventors: Peter Vinci, Mount Tremper, NY (US); Ian R. Vinci, Shandaken, NY (US)

(73) Assignee: Innovative Products of America, Inc., Woodstock, NY (US)

( * ) Notice: Subject to any disclaimer, the term of this patent is extended or adjusted under 35 U.S.C. 154(b) by 652 days.

(21) Appl. No.: 12/436,256

(22) Filed: May 6, 2009

(65) Prior Publication Data

US 2010/0281639 A1 Nov. 11, 2010

(51) Int. Cl.
*A47L 25/00* (2006.01)

(52) U.S. Cl. ..... 15/104.001; 15/104.04; 15/236.06; 15/236.07; 407/29.1; 407/29.15; 451/557; 451/558

(58) Field of Classification Search ..... 15/104.001, 15/104.04, 160, 210.1, 105, 236.01, 236.05–236.09; 407/29.1, 29.12, 29.15; 451/557, 558, 461, 451/462; 29/525.11, 525, 700, 729
See application file for complete search history.

(56) References Cited

U.S. PATENT DOCUMENTS

| | | | | | |
|---|---|---|---|---|---|
| 749,011 | A * | 1/1904 | Adams | 15/105.53 |
| 1,177,187 | A * | 3/1916 | Jones | 15/160 |
| 2,088,664 | A * | 8/1937 | Peck | 451/558 |
| 2,746,219 | A * | 5/1956 | Talbot | 451/430 |
| 3,214,824 | A * | 11/1965 | Brown | 29/81.02 |
| 3,504,459 | A * | 4/1970 | Spiteri | 451/525 |
| 5,055,055 | A * | 10/1991 | Bakker | 439/78 |
| 5,193,315 | A * | 3/1993 | Martinez | 451/63 |
| 5,632,655 | A * | 5/1997 | DeMarco, Jr. | 439/655 |
| 5,660,582 | A * | 8/1997 | Terris | 451/359 |
| 6,796,882 | B1 * | 9/2004 | Pulcher et al. | 451/28 |
| 7,354,336 | B1 * | 4/2008 | Lalancette et al. | 451/28 |
| 2010/0251496 | A1 * | 10/2010 | Vinci et al. | 15/104.05 |

* cited by examiner

*Primary Examiner* — Mark Spisich
*Assistant Examiner* — Michael Jennings
(74) *Attorney, Agent, or Firm* — Law Offices of Michael L. Wise, LLC

(57) ABSTRACT

An apparatus for cleaning male electrical pins comprises a base portion, a first cleaning extension, and a second cleaning extension. The first cleaning extension extends from the base portion and defines a first substantially half-cylindrical shell. Likewise, the second cleaning extension extends from the base portion in a direction substantially parallel to the first cleaning extension, and defines a second substantially half-cylindrical shell. The first cleaning extension and the second cleaning extension define a gap therebetween. In addition, each of the first and second substantially half-cylindrical shells comprises a respective knurled surface region facing the gap.

19 Claims, 3 Drawing Sheets

APPARATUS FOR CLEANING MALE ELECTRICAL PINS

FIELD OF THE INVENTION

The present invention relates generally to electrical connectors, and, more particularly, to apparatus for cleaning male electrical pins.

BACKGROUND OF THE INVENTION

Most trailers that are towed by vehicles may be connected to the towing vehicle's electrical system. The towing vehicle's electrical system may operate the trailer's lights and brakes, and may even supply power for electrical appliances on the trailer (e.g., interior lights, refrigerators, and winches). To facilitate the electrical connection, the trailer is usually equipped with a standard "pigtail" electrical connector that couples to a corresponding electrical connector on the towing vehicle. The electrical connector on the towing vehicle may be either original equipment installed by the manufacturer, or an after-market device installed by the consumer.

There are several variations in the types of connector technologies that are used to couple a trailer to the electrical system of its towing vehicle. These various technologies typically utilize a combination of male electrical pins and female electrical terminals to form the various individual electrical connections. FIGS. 1A and 1B, for example, show perspective views of a trailer connector 100 and a towing vehicle connector 110, respectively, in accordance with what is commonly called the "4-way round" connector technology. As can be seen in the figures, the trailer connector comprises a male plug 120 having four female electrical terminals 130. The towing vehicle connector, on the other hand, comprises a female socket 140 having four inversely arranged male electrical pins 150. Each of these four male electrical pins in the towing vehicle's female socket is inserted into and makes electrical contact with a corresponding female electrical terminal in the trailer's male plug when the male plug is correctly inserted into the female socket.

Because of their relationship to safety, it is critical that each electrical contact on the trailer's connector, whether it is a male electrical pin or a female electrical terminal, be capable of forming a low-resistance electrical connection with its corresponding electrical contact on the towing vehicle's connector. Unfortunately, this requirement is made more difficult by the environment in which these connectors operate. Because of their placement in relation to the towing vehicle, these connectors and their electrical contacts are frequently exposed to dirt and moisture. Dirt can coat the electrical contacts, forming a high-resistance surface layer. Moisture, especially when combined with road salt, can corrode the electrical contacts. In an attempt to mitigate these issues, some connectors include covers for protecting their electrical contacts when the connectors are not in use. The towing vehicle connector 110 in FIG. 1B, for example, includes a spring-loaded hatch cover 160. Nevertheless, such covers are often ineffective because of the extreme conditions to which these connectors are exposed. This is true especially for corrosion.

For the foregoing reasons, there is a need for a low-cost apparatus that makes it easy and convenient to clean dirt and corrosion from male electrical pins on trailer connectors as well as other types of connectors so that these electrical pins are capable of reliably forming low-resistance electrical connections.

SUMMARY OF THE INVENTION

Embodiments of the present invention address the above-identified need by providing a low-cost apparatus that makes it easy and convenient to clean dirt and corrosion from male electrical pins.

In accordance with an aspect of the invention, an apparatus for cleaning male electrical pins comprises a base portion, a first cleaning extension, and a second cleaning extension. The first cleaning extension extends from the base portion and defines a first substantially half-cylindrical shell. Likewise, the second cleaning extension extends from the base portion in a direction substantially parallel to the first cleaning extension, and defines a second substantially half-cylindrical shell. The first cleaning extension and the second cleaning extension define a gap therebetween. In addition, each of the first and second substantially half-cylindrical shells comprises a respective knurled surface region facing the gap.

In accordance with another aspect of the invention, the above-described apparatus further comprises a handle.

Moreover, in accordance with even another aspect of the invention, the apparatus comprises an arc-shaped clip that elastically biases the first cleaning extension towards the second cleaning extension.

In accordance with one of the above-identified embodiments of the invention, a hand tool for cleaning male electrical pin comprises a cleaning bit and a handle. The cleaning bit, in turn, comprises two mirror-image cleaning extensions that extend from a base portion and define a gap therebetween. Each cleaning extension defines a respective substantially half-cylindrical shell that comprises a respective inward-facing knurled surface region. An arc-shaped clip acts to elastically bias the first cleaning extension towards the second cleaning extension. When a male electrical pin is inserted into the gap between the cleaning extensions, the inward-facing knurled surface regions of the cleaning extensions are forced against the outside surface of the male electrical pin with sufficient force to allow them to effectively scrape off any dirt or corrosion on that surface as the cleaning bit is moved.

Advantageously, this hand tool embodiment makes it easy and convenient to clean dirt and corrosion from male electrical pins on trailer connectors as well as other types of connectors so that these electrical pins are reliably capable of forming low-resistance electrical connections.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

Figure 2:
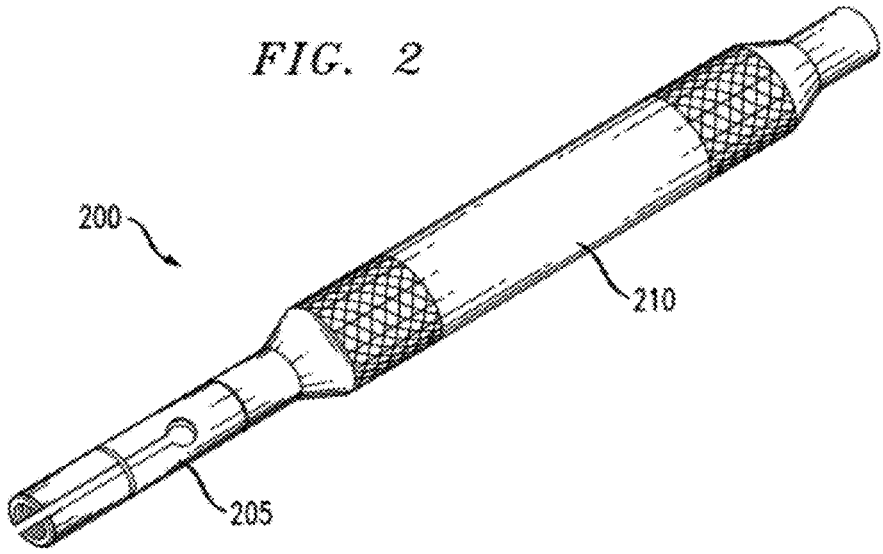
FIG. 2 shows a perspective view of an apparatus in accordance with an illustrative embodiment of the invention.

FIG. 2 shows a perspective view of an apparatus 200 in accordance with an illustrative embodiment of the invention. The apparatus is in the form of a hand tool having a cleaning bit 205 mounted onto a handle 210.

Figure 3A:
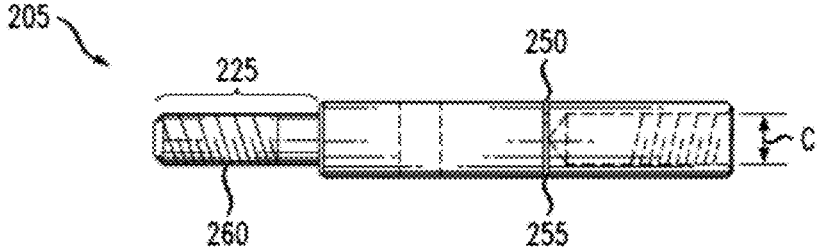
FIGS. 3A-3C show a transparent top view, a transparent side view, and an end view, respectively, of the cleaning bit in the FIG. 2 apparatus.
Figure 3C:
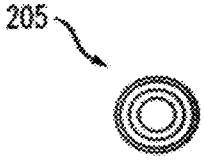
Figure 3B:
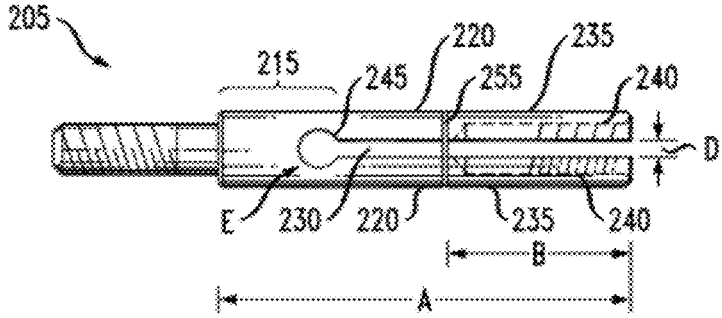

Additional details of the illustrative apparatus 200 may be seen in FIGS. 3A-3C and FIGS. 4A-4C. FIGS. 3A-3C show a transparent top view, a transparent side view, and an end view, respectively, of the cleaning bit 205. The cleaning bit comprises a base portion 215 that is connected to two cleaning extensions 220 at one end, and a mounting portion 225 at the other end. These elements preferably comprises steel, such as cold rolled steel. The cleaning extensions extend from the base portion in a direction substantially parallel to each other and are separated by a gap 230. Moreover, each cleaning extension terminates in a respective substantially half-cylindrical shell 235. Each substantially half-cylindrical shell comprises a knurled surface region 240 that faces toward the gap (hereinafter called the "inward-facing knurled surface regions 240"). The two cleaning extensions are, in fact, substantially mirror images of one another.

As further indicated in the figures, the base portion 215 defines a circular cutout 245 therein, which intersects the gap 230 defined by the cleaning extensions 220. What is more, each of the cleaning extensions defines a respective groove 250 thereon. An arc-shaped clip 255 is at least partially disposed within these grooves. The arc-shaped clip is preferably made of a springy (i.e., elastic) material and is dimensioned so that it compresses the cleaning extensions somewhat toward one another. The arc-shaped clip may also, for example, comprise steel. In this manner, the arc-shaped clip acts to elastically bias one cleaning extension towards the other cleaning extension.

The mounting portion 225 of the cleaning bit 205, in turn, comprises a threaded cylindrical portion 260. The threaded cylindrical portion allows the cleaning bit to be mounted on the handle 210.

Figure 4A:
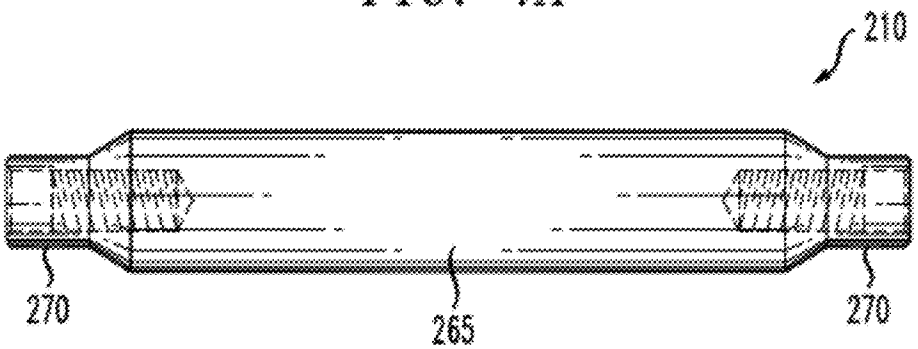
FIG. 4A-4C show a transparent side view, a side view, and an end view, respectively, of the handle in the FIG. 2 apparatus.
Figure 4B:
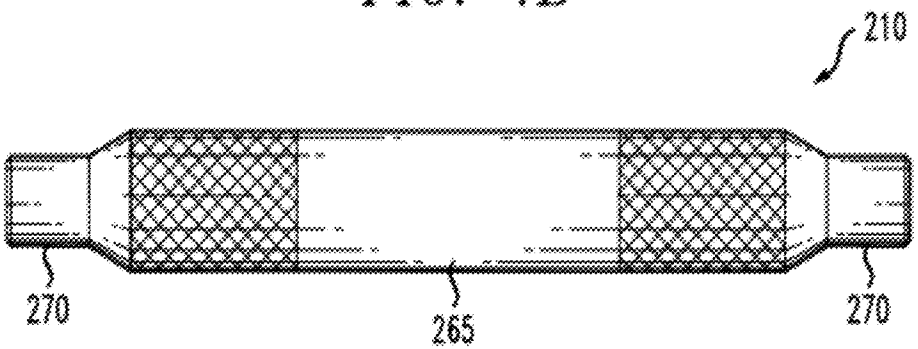
Figure 4C:
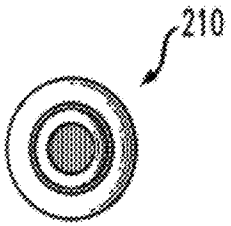

FIGS. 4A-4C show a transparent side view, a side view, and an end view, respectively, of the handle 210. The handle comprises a cylindrical handle portion 265 with two tapered ends 270. It may be formed of, as just one example, aluminum. Each tapered end is tapped (i.e., comprises internal screw threads) so that it can accommodate one cleaning bit. In this manner, a single handle can support two different cleaning bits if such an arrangement is desired. Portions of the handle are also knurled to provide a user with better purchase on the tool during use.

Figure 1A:
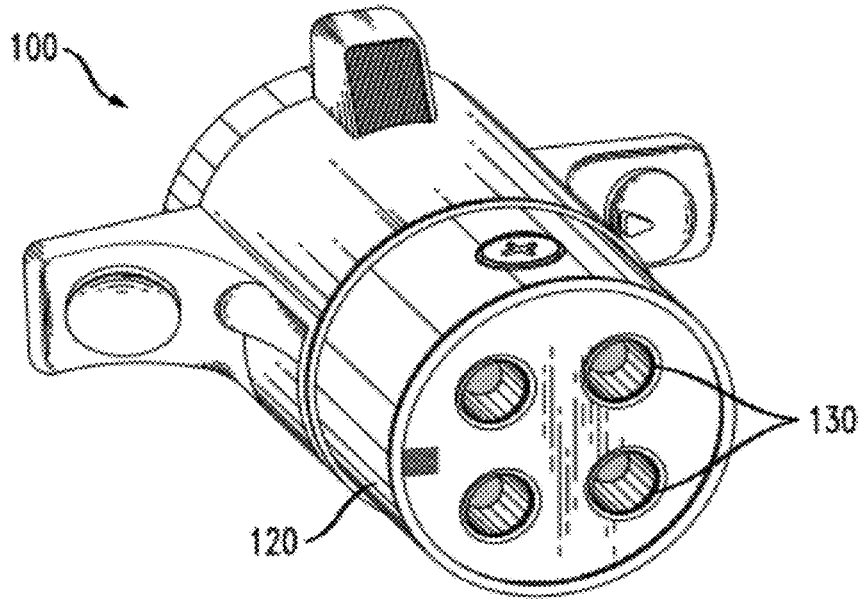
FIG. 1A shows a perspective view of an illustrative trailer connector.
Figure 1B:
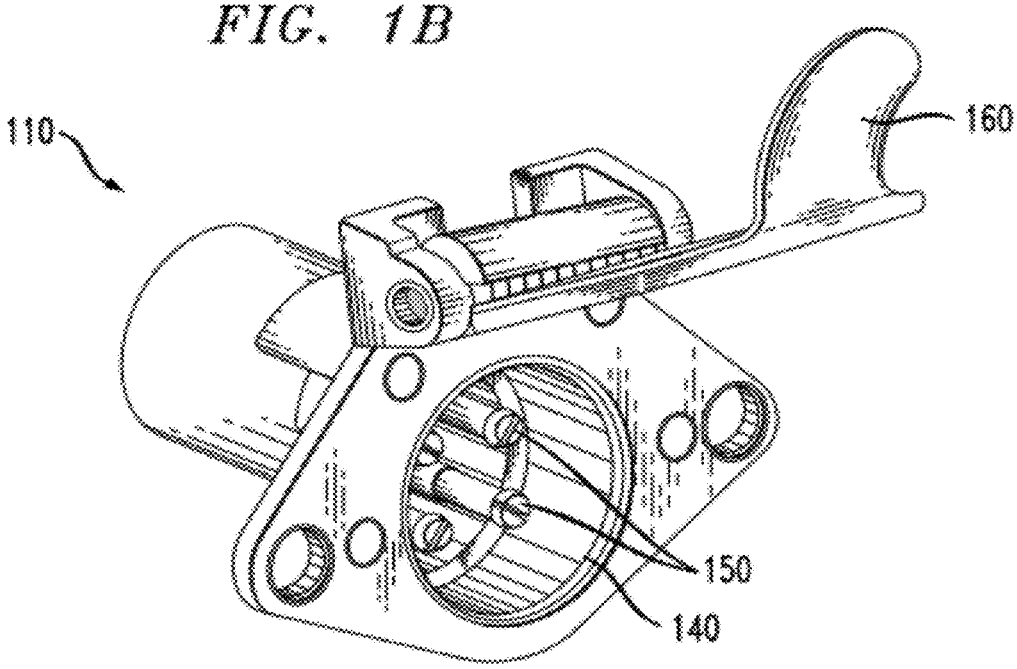
FIG. 1B shows a perspective view of an illustrative towing vehicle connector.

It is the inward-facing knurled surface regions 240 of the cleaning extensions 220 that are primarily tasked with cleaning the surface of a male electrical pin (e.g., the male electrical pin 120 in FIG. 1B). The apparatus 200 is dimensioned such that inserting a male electrical pin into the gap between the cleaning extensions causes the inward-facing knurled surface regions to simultaneously contact the surface of that pin while, at the same time, causing the cleaning extensions to bend somewhat apart from each other. Such bending occurs primarily at the thinned regions of the base portion 215 proximate to the circular cutout 245. Nevertheless, the tendency of the material constituting the cleaning bit 205 (e.g., steel) to resist such bending in combination with the elastic biasing provided by the arc-shaped clip 255 resist this bending motion. The result is that the inward-facing knurled surface regions of the cleaning extensions are forced against the outside surface of the male electrical pin with sufficient force to allow them to effectively scrape off any dirt or corrosion on that surface as the cleaning bit is moved.

If it is desired, for example, that the cleaning bit 205 be used to clean a male electrical pin in accordance with standard "4-way," "5-way," and "6-way" trailer applications, the cleaning bit may be dimensioned such that (referring to the dimensions marked on FIGS. 3A and 3B):

A=1.3 inches length;
B=0.55 inches length;
C=0.17 inches length;
D=0.050 inches length; and
E=0.13 inches diameter.

Of course, it is contemplated that dimensions substantially different from these will also be appropriate depending on the particular application (e.g., depending on the size of the male electrical pin). Knurling of the inward-facing knurled surface regions 240 may be accomplished by simply tapping these surface regions so that they are characterized by internal screw threads. These screw threads have no functional purpose other than providing a roughened (i.e., knurled) cleaning surface.

Using the apparatus 200, the cleaning of a male electrical pin becomes the simple act of inserting the male electrical pin into the gap 230 between the cleaning extensions 220 such that the inward-facing knurled surface regions 240 make contact with the outside surface of the pin, and manually providing the cleaning bit with an inward-outward motion and/or twisting motion using the handle 210. The curved and knurled surface regions, in turn, scrape the outside surface of the male electrical pin and remove any dirt or corrosion thereon.

Nevertheless, it should again be emphasized that the above-described embodiment of the invention is intended to be illustrative only. Embodiments of the invention, for example, can be utilized to clean male electrical pins on any type of connector, not necessarily those associated with trailers or towing vehicles. Moreover, embodiments can use different elements, materials, and dimensions and still come within the scope of the invention. A cleaning bit in accordance with aspects of the invention may, as just another example, be adapted so that it can be chucked onto a power tool such as an electric hand drill. These numerous alternative embodiments within the scope of the appended claims will be apparent to one skilled in the art.

Finally, all the features disclosed herein may be replaced by alternative features serving the same, equivalent, or similar purpose, unless expressly stated otherwise. Thus, unless expressly stated otherwise, each feature disclosed is one example only of a generic series of equivalent or similar features.

What is claimed is:

1. An apparatus for cleaning male electrical pins, the apparatus comprising:

a base portion;

a first cleaning extension extending from the base portion, the first cleaning extension defining a first substantially half-cylindrical shell; and a second cleaning extension extending from the base portion in a direction substantially parallel to the first cleaning extension, the second cleaning extension defining a second substantially half-cylindrical shell;

wherein the first cleaning extension and the second cleaning extension define a gap therebetween, and wherein each of the first and second substantially half-cylindrical shells comprises a respective knurled surface region facing the gap.

2. The apparatus of claim 1, wherein the base portion defines a substantially circular cutout that intersects the gap.

3. The apparatus of claim 1, wherein the second cleaning extension is substantially a mirror image of the first cleaning extension.

4. The apparatus of claim 1, wherein the first and second cleaning extensions each define a respective groove thereon.

5. The apparatus of claim 1, further comprising a substantially arc-shaped clip.

6. The apparatus of claim 5, wherein the arc-shaped clip acts to elastically bias the first cleaning extension towards the second cleaning extension.

7. The apparatus of claim 1, wherein:

the apparatus further comprises a substantially arc-shaped clip;

the first and second cleaning extensions each define a respective groove thereon; and the substantially arc-shaped clip is disposed at least partially within the grooves.

8. The apparatus of claim 1, further comprising a mounting portion attached to the base portion, the mounting portion comprising a threaded cylindrical portion.

9. The apparatus of claim 1, further comprising a handle.

10. The apparatus of claim 9, wherein the handle comprises internal screw threads.

11. The apparatus of claim 1, wherein the apparatus comprises steel.

12. The apparatus of claim 1, wherein the apparatus is adapted so that a male electrical pin can be inserted into the gap such that the knurled surface regions simultaneously contact a surface of the male electrical pin.

13. The apparatus of claim 1, wherein the apparatus is in the form of a hand tool.

14. An apparatus for cleaning male electrical pins, the apparatus comprising:

a base portion;

a first cleaning extension extending from the base portion, the first cleaning extension defining a first substantially half-cylindrical shell;

a second cleaning extension extending from the base portion in a direction substantially parallel to the first cleaning extension, the second cleaning extension defining a second substantially half-cylindrical shell; and a handle attached to the base portion;

wherein the first cleaning extension and the second cleaning extension define a gap therebetween, and wherein each of the first and second substantially half-cylindrical shells comprises a respective knurled surface region facing the gap.

15. The apparatus of claim 14, wherein the second cleaning extension is substantially a mirror image of the first cleaning extension.

16. The apparatus of claim 14, wherein the apparatus is adapted so that a male electrical pin can be inserted into the gap such that the knurled surface regions simultaneously contact a surface of the male electrical pin.

17. An apparatus for cleaning male electrical pins, the apparatus comprising:

a base portion;

a first cleaning extension extending from the base portion, the first cleaning extension defining a first substantially half-cylindrical shell;

a second cleaning extension extending from the base portion in a direction substantially parallel to the first cleaning extension, the second cleaning extension defining a second substantially half-cylindrical shell; and a substantially arc-shaped clip, the substantially arc-shaped clip acting to elastically bias the first cleaning extension towards the second cleaning extension;

wherein the first cleaning extension and the second cleaning extension define a gap therebetween, and wherein each of the first and second substantially half-cylindrical shells comprises a respective knurled surface region facing the gap.

18. The apparatus of claim 17, wherein the second cleaning extension is substantially a mirror image of the first cleaning extension.

19. The apparatus of claim 17, wherein the apparatus is adapted so that a male electrical pin can be inserted into the gap such that the knurled surface regions simultaneously contact a surface of the male electrical pin.

* * * * *